US009764384B2

(12) United States Patent
Mittendorf et al.

(10) Patent No.: US 9,764,384 B2
(45) Date of Patent: Sep. 19, 2017

(54) METHODS OF PRODUCING DISPERSOID HARDENED METALLIC MATERIALS

(71) Applicant: HONEYWELL INTERNATIONAL INC., Morristown, NJ (US)

(72) Inventors: Don Mittendorf, Mesa, AZ (US); Vladimir K. Tolpygo, Scottsdale, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 274 days.

(21) Appl. No.: 14/686,313

(22) Filed: Apr. 14, 2015

(65) Prior Publication Data

US 2016/0303653 A1 Oct. 20, 2016

(51) Int. Cl.
*C22C 1/04* (2006.01)
*B22F 1/00* (2006.01)
(Continued)

(52) U.S. Cl.
CPC ..... *B22F 1/0081* (2013.01); *B22F 1/0003* (2013.01); *B22F 1/0085* (2013.01);
(Continued)

(58) Field of Classification Search
None
See application file for complete search history.

(56) References Cited

U.S. PATENT DOCUMENTS 3,753,795 A * 8/1973 Weber ..... C22C 32/0026 148/410
3,779,714 A 12/1973 Nadkarni et al.
(Continued)

FOREIGN PATENT DOCUMENTS

DE 2262132 A1 6/1974
WO 2015001241 A2 1/2015

OTHER PUBLICATIONS

Bestor, M.A., et al; Influences of chromium and hafnium additions on the microstructures of b-nial coatings on superalloy substrates; Intermetallics 19 (2011) 1693e1704; The University of Alabama, Department of Metallurgical and Materials Engineering; journal homepage: www.elsevier.com/locate/intermet.
(Continued)

*Primary Examiner* — George Wyszomierski
(74) *Attorney, Agent, or Firm* — Lorenz & Kopf, LLP

(57) ABSTRACT

Methods of forming dispersoid hardened metallic materials are provided. In an exemplary embodiment, a method of producing dispersoid hardened metallic materials includes forming a starting composition with a base metal component and a dispersoid forming component. The starting composition includes the base metal component in an amount from about 50 to about 99.999 weight percent and the dispersoid forming component in an amount from about 0.001 to about 1 weight percent, based on the total weight of the starting composition. A starting powder is formed from the starting composition, and the starting powder is fluidized with a fluidizing gas for a period of time sufficient to oxidize the dispersoid forming component to form the dispersoid hardened metallic material. The dispersoid forming component is oxidized while the starting powder is a solid.

20 Claims, 1 Drawing Sheet

(51) Int. Cl.

| | |
|---|---|
| ***C22C 1/05*** | (2006.01) |
| ***C22C 1/10*** | (2006.01) |
| ***C22C 32/00*** | (2006.01) |
| ***B22F 1/02*** | (2006.01) |
| ***B22F 9/16*** | (2006.01) |

(52) U.S. Cl.

CPC ..... *B22F 1/02* (2013.01); *B22F 9/16* (2013.01); *C22C 1/056* (2013.01); *C22C 1/1036* (2013.01); *C22C 1/1068* (2013.01); *C22C 32/0026* (2013.01)

(56) References Cited

U.S. PATENT DOCUMENTS

| | | | | |
|---|---|---|---|---|
| 3,992,161 | A * | 11/1976 | Cairns | C22C 32/0026 75/234 |
| 5,429,793 | A | 7/1995 | Ong et al. | |
| 5,480,468 | A | 1/1996 | Ritter et al. | |
| 5,510,080 | A | 4/1996 | Nishi et al. | |
| 5,571,304 | A | 11/1996 | Ritter et al. | |
| 5,989,491 | A | 11/1999 | Isomoto et al. | |
| 6,143,241 | A | 11/2000 | Hajaligol et al. | |
| 6,168,871 | B1 | 1/2001 | Ritter et al. | |
| 6,485,584 | B1 | 11/2002 | Lambard et al. | |
| 6,893,481 | B2 | 5/2005 | Nam et al. | |
| 7,361,235 | B2 | 4/2008 | Ohtsuka et al. | |
| 7,699,905 | B1 | 4/2010 | Anderson et al. | |
| 8,313,810 | B2 | 11/2012 | Helmick et al. | |
| 8,603,213 | B1 | 12/2013 | Anderson et al. | |
| 8,748,008 | B2 | 6/2014 | Chun et al. | |
| 2008/0142126 | A1 | 6/2008 | Gigliotti et al. | |
| 2009/0123690 | A1 | 5/2009 | Scholl et al. | |
| 2010/0279146 | A1 | 11/2010 | Rowe et al. | |
| 2012/0244456 | A1 | 9/2012 | Muecke et al. | |
| 2013/0255843 | A1 | 10/2013 | Kiuchi et al. | |
| 2014/0294653 | A1 | 10/2014 | Kim et al. | |
| 2015/0027993 | A1 | 1/2015 | Bruck et al. | |

OTHER PUBLICATIONS

Humbert, M.; Oxide Dispersion Strengthened Alloys; 3.40 Dec. 17, 2012; Reference Notes available online at http://li.mit.edu/Stuff/PM/Termpaper/MattHumbert-termpaper.pdf.

Li, D, et al.; Cyclic oxidation of b-NiAl with various reactive element dopants at 1200 C; Corrosion Science 66 (2013) 125-135; School of Materials Science and Engineering, Beihang University, No. 37, Beijing Key Laboratory for Advanced Functional Material and Thin Film Technology, Beihang University, No. 37; journal homepage: www.elsevier.com/locate/corsci.

Ohtsuka, S. et al.; High temperature reaction tests between high-Cr ODS ferritic steels and U—Zr metallic fuel; Journal of Nuclear Materials 441 (2013) 286-292; Advanced Nuclear System R&D Directorate, Japan Atomic Energy Agency, Graduate School of Engineering, Hokkaido University, Kobelco Research Institute, Japan, Institute of Advanced Energy, Kyoto University; journal homepage: www.elsevier.com/locate/jnucmat.

Extended EP Search Report for Application No. 16163946.3-1373 dated Jul. 29, 2016.

* cited by examiner

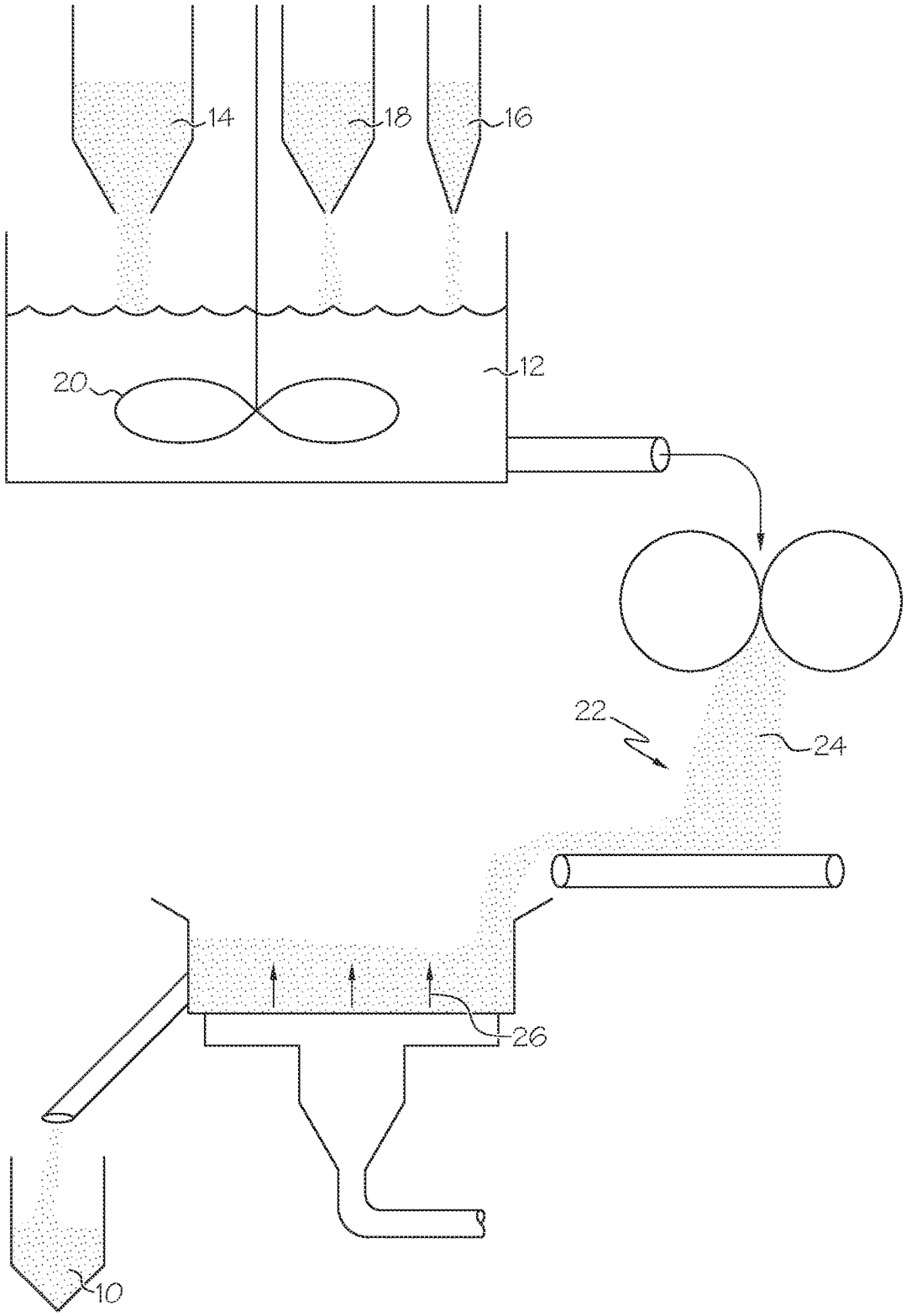
14
18
16
12
20
22
24
26
10

METHODS OF PRODUCING DISPERSOID HARDENED METALLIC MATERIALS

TECHNICAL FIELD

The present disclosure generally relates to methods of forming dispersoid hardened metallic materials, and more particularly relates to methods of forming dispersoids in metallic powders in solid form.

BACKGROUND

Many metals can be hardened by including dispersoids within a matrix of the metal. Dispersoid strengthened metallic materials include a metal matrix, which may be an alloy, with dispersoids distributed throughout the matrix. Dispersoids are typically oxides of a metallic component, where the metallic component that is oxidized is different than the bulk of the metal material. The dispersoids increase the strength and hardness of the metallic matrix. Dispersoid hardened metallic materials have been formed mechanically, where a dispersoid (such as yttrium oxide ($Y_2O_3$)) is extensively milled and then blended with a base metal component, such as iron (Fe) and chromium (Cr) powders. The milling and blending process may proceed for days to produce the desired product, in part because the desired size of the dispersoids is quite small, such as 1 micron or less. After milling and blending, thermo-mechanical treatments may be used for secondary recrystallization that can produce a stronger microstructure. The thermo-mechanical treatment may be hot rolling with high temperature treatment, for example, but other treatments are also possible. The cost to mechanically produce dispersoid hardened metallic materials is prohibitive, and this high cost has prevented widespread use of dispersoid hardened metallic materials.

Accordingly, it is desirable to provide methods for producing dispersoid hardened metallic materials that are economically viable. In addition, it is desirable to provide methods of forming dispersoid hardened metallic materials in a reasonable time period, where the dispersoids have a particle size of about 1 micron or less. Furthermore, other desirable features and characteristics of the present embodiment will become apparent from the subsequent detailed description and the appended claims, taken in conjunction with the accompanying drawings and this background of the invention.

BRIEF SUMMARY

Methods of forming dispersoid hardened metallic materials are provided. In an exemplary embodiment, a method of producing dispersoid hardened metallic materials includes forming a starting composition with a base metal component and a dispersoid forming component. The starting composition includes the base metal component in an amount from about 50 to about 99.999 weight percent and the dispersoid forming component in an amount from about 0.001 to about 1 weight percent, based on the total weight of the starting composition. A starting powder is formed from the starting composition, and the starting powder is fluidized with a fluidizing gas for a period of time sufficient to oxidize the dispersoid forming component to form the dispersoid hardened metallic material. The dispersoid forming component is oxidized while the starting powder is a solid.

A method for forming dispersoid hardened metallic materials is provided in another embodiment. The method includes forming a starting composition with a base metal component and a dispersoid forming component. The base metal component is from about 50 to about 99.999 weight percent of the starting composition, and the dispersoid forming component is from about 0.001 to about 1 weight percent of the starting composition. A staring powder is formed from the starting composition, where the starting powder includes starting particulates. An oxidizing agent is diffused into the starting particulates while in a solid state, and the dispersoid forming component is oxidized within the starting particulates while in the solid state to form the dispersoid hardened metallic material.

A method for forming dispersoid hardened metallic materials is provided in yet another embodiment. The method includes forming a starting composition with a base metal component and a dispersoid forming component. The base metal component is from about 50 to about 99.999 weight percent of the starting composition, and the dispersoid forming component is from about 0.001 to about 1 weight percent of the starting composition. About 50 weight percent or more of the dispersoid forming component within the starting composition is preferentially oxidized while the starting composition is in a solid state, and about 95 weight percent or more of the base metal component is present in a reduced state.

BRIEF DESCRIPTION OF THE DRAWINGS

Various embodiments will hereinafter be described in conjunction with the FIGURE, which is a schematic diagram of an exemplary embodiment of an apparatus and method for producing dispersoid hardened metallic materials.

DETAILED DESCRIPTION

The following detailed description is merely exemplary in nature and is not intended to limit the various embodiments or the application and uses of the invention. Furthermore, there is no intention to be bound by any expressed or implied theory presented in the preceding technical field, background, brief summary, or the following detailed description.

Referring to the FIGURE, a method for producing a dispersoid hardened metallic material 10 is provided in accordance with an exemplary embodiment. In this description, a "metallic material" is a material that has the physical properties of a metal, and wherein a majority of the chemical bonds in the metallic material are metallic bonds. As such, a metallic material may include metalloids or non-metals, as long as the metallic properties and metallic bonding are present. The method includes providing a starting composition 12 that includes a base metal component 14, a dispersoid forming component 16, and optionally an alloy material 18, all of which are in a reduced state. The base metal component 14 is a metallic material that forms about 50% or more of the starting composition 12. As used herein, the term "reduced state" means a small percentage or no oxide-bound material of the composition is present, such that about 0 up to a maximum of about 10 weight percent of the material is chemically bound to an oxygen atom. In an exemplary embodiment, the base metal component 14 consists of nickel (Ni), cobalt (Co), iron (Fe), copper (Cu), or a combination thereof, and the base metal component 14 is present in the starting composition 12 at from about 50 to about 99.999 weight percent, where the weight percent is based on the total weight of the starting composition 12. In alternate embodiments, the base metal component 14 is present in the starting composition 12 at from about 60 to about 99.999 weight percent, or about 70 to about 99.999 weight percent. The starting composition 12 may also include oxides of the materials within the base metal component 14 at low concentrations, such as from about 0 to about 10 weight percent, or from about 0.001 to about 10 weight percent, or from about 0.001 to about 5 weight percent in various embodiments. The starting composition 12 also includes a dispersoid forming component 16 at from about 1 to about 0.001 weight percent, or at from about 0.5 to about 0.001 weight percent, or at from about 0.2 to about 0.001 weight percent in various embodiments.

The dispersoid forming component 16 includes an element that is more easily oxidized than the base metal component 14. In an exemplary embodiment, the dispersoid forming component 16 may include a metal that is as easy or easier to oxidize than aluminum. For example, the dispersoid forming component 16 may be selected from the group consisting of hafnium, zirconium, yttrium, scandium, lanthanum, cerium, praseodymium, neodymium, promethium, samarium, europium, gadolinium, terbium, dysprosium, holmium, erbium, thulium, ytterbium, lutetium, and combinations thereof. In an alternate embodiment, the dispersoid forming component 16 includes aluminum. In yet another embodiment, the dispersoid forming component 16 is selected from the group consisting of hafnium, zirconium, and yttrium. As with the base metal component 14, oxides of the dispersoid forming component 16 may be present in the starting composition 12 at low concentrations, such as from about 0 to about 0.1 weight percent, or from 0.0001 to about 0.1 weight percent, or from about 0.0001 to about 0.01 weight percent in various embodiments.

The starting composition 12 may optionally include an alloy material 18 at from about 0 to about 50 weight percent, where the alloy material 18 may be almost any compound. As used herein, the term "alloy" means a metallic material formed with the base metal component 14 and one or more alloy materials 18, where the alloy has one or more improved properties over the base metal component 14. In alternate embodiments, the alloy material 18 is present in the starting composition 12 at from about 5 to about 50 weight percent, or from about 10 to about 40 weight percent, or from about 10 to about 30 weight percent. The starting composition 12 may also include other compounds in some embodiments, such as carbon or impurities. The dispersoid forming component 16 is also more easily oxidized than the alloy material 18, in embodiments where an alloy material 18 is present. The dispersoid forming component 16, the base metal component 14, and the optional alloy material 18 are selected such that the dispersoid forming component 16 is more easily oxidized than either of the base metal component 14 or the alloy material 18, so the selection of the base metal component 14 and the alloy material 18 may influence the selection of the dispersoid forming component 16. For example, if the alloy material 18 is aluminum, the dispersoid forming component 16 is a material that is more easily oxidized than aluminum. However, if the base metal component 14 and the alloy material 18 are both more resistant to oxidizing than aluminum, then the dispersoid forming component 16 may include aluminum.

The components of the starting composition 12 may be combined and melted to form a melt, so the components of the starting composition 12 can be thorough mixed. For example, the molten starting composition 12 may be mixed with an impeller 20, as illustrated, but many other mixing techniques may also be used, including but not limited to a magnetic mixing bar, a static mixer, or simple addition where combining and pouring the material provides adequate mixing. In an alternate embodiment, the components of the starting composition 12 may be combined and mixed as a powder, or the starting composition 12 may be acquired with the various components already present, such as from a recycling process, so no additional mixing is required.

In some embodiments, the starting composition 12 is formed into a starting powder 22, where the starting powder 22 includes a plurality of starting particulates 24. The starting composition 12 may be formed into the starting powder 22 in a wide variety of manners, including but not limited to crushing (as illustrated) and atomizing. Many apparatuses are available for crushing the starting composition 12, such as hammer mills, ball mills, rollers, etc., and the starting composition 12 may be formed into a sponge-like material or other forms conducive to powder formation prior to the crushing process. In an alternate embodiment, liquid starting composition 12 is formed into small droplets and rapidly frozen to form the starting powder 22, such as by exposing a small stream of molten starting composition 12 to high energy gaseous or liquid jets. Other options are possible for forming the starting composition 12 into the starting powder 22. In an exemplary embodiment, the starting particulates 24 of the starting powder 22 have an average particle size of about 50 microns or less, or about 30 microns or less, or about 10 microns or less in various embodiments, where the average particle size is the D50 particle size, or the median value of the particle size distribution. The starting powder 22 may be passed through a screen such that starting particulates 24 larger than the desired size are excluded. The larger particles may then be reprocessed and reduced in size, disposed of, or otherwise used. The shape of the starting particulates 24 is not critical.

The dispersoid forming component 16, the base metal component 14, and any other components of the starting composition 12 are randomly distributed within the starting particulates 24, because the various components were evenly mixed and distributed within the starting composition 12 before it was formed into a powder.

The dispersoid forming component 16 is preferentially oxidized to form a dispersoid within the starting particulates 24, while little to none of the base metal component 14 and the optional alloy material 18 are oxidized. In an exemplary embodiment, about 50 weight percent or more of the dispersoid forming component 16 is oxidized while about 95 weight percent or more of the base metal component 14 and about 95 weight percent or more of the alloy material 18 (if present) are present in the reduced state. In alternate embodiments, about 40 weight percent or more of the dispersoid forming component 16 is oxidized while about 95 weight percent or more of the base metal component 14 and about 95 weight percent or more of the alloy material 18 (if present) are present in the reduced state, or about 30 weight percent or more of the dispersoid forming component 16 is oxidized while about 95 weight percent or more of the base metal component 14 and about 95 weight percent or more of the alloy material 18 (if present) are present in the reduced state. The dispersoid forming component 16 is oxidized with an oxidizing agent, such as oxygen, carbon monoxide, water, or other materials that include oxygen. Without being bound by any particular theory, it is believed that the oxidizing agent oxidizes the dispersoid forming component 16 on the surface of the starting particulates 24, and the oxidizing agent diffuses into the starting particulates 24 and oxidizes some or all of the dispersoid forming component 16 positioned within the interior of the starting particulates 24. In an exemplary embodiment, to preferentially oxidize the dispersoid forming component 16, the starting powder 22 is fluidized with a fluidizing gas 26 for a period of time sufficient to oxidize the dispersoid forming component 16, where the fluidizing gas 26 includes the oxidizing agent. As such, the oxidizing agent is external to the starting particulates 24 prior to exposure to the fluidizing gas 26, so the oxidizing agent must diffuse into the starting particulates 24 to oxide much of the dispersoid forming component 16. The fluidizing gas 26 may also include an inert component, such as nitrogen, argon, helium, etc. In many embodiments, the majority of the fluidizing gas 26 is inert.

The particle size of the starting particulates 24 may be selected such that the oxidizing agent is capable of diffusing into the starting particulates 24 within a reasonable period of time at the oxidizing conditions employed. Therefore, the particle size may vary for different compositions of the starting composition 12, because different compositions may have different diffusivities at the oxidizing conditions in use. In some embodiments, the oxidizing agent may not diffuse to the core of the starting particulates 24, so some of the dispersoid forming component 16 may remain in a reduced state. The low concentrations of dispersoid forming component 16 in a reduced state generally does not impair the properties of the final product, and a majority of the dispersoid forming component 16 is generally oxidized to form dispersoids.

The starting particulates 24 are in the solid state while the dispersoid forming component 16 is oxidized. The starting powder 22 is maintained at an oxidizing temperature, or within an oxidizing temperature range, while the dispersoid forming component 16 is oxidized. The oxidizing temperature is below the melting point of the base metal component 14, and the starting particulates 24 remain in the solid state while the dispersoid forming component 16 is oxidized. In an exemplary embodiment, the oxidizing temperature is below the solidus temperature of starting composition 12. If the oxidizing temperature were at or above the melting point of the base metal component 14, some or all of the starting powder 22 may melt during the oxidation of the dispersoid forming component 16. If the starting powder 22 melts, the dispersoid forming component 16 may tend to agglomerate or grow in size, which produces larger dispersoids. Smaller dispersoids are generally desired, so the oxidizing temperature is kept below the melting point of the base metal component 14 to limit agglomeration. As such, the average particle size (D50, as described above) of the dispersoids formed is about 1 micron or less, or about 0.5 microns or less, or about 0.3 microns or less in various embodiments. If the starting particulates 24 were liquid (i.e., liquid droplets of the starting composition 12), the different components may tend to segregate somewhat, such as due to varying densities resulting in denser material accumulating near the outer surface of the starting particulates 24 due to centrifugal force from spinning. Other properties may also cause segregation of the components, such as different electronegativity, etc. However, since the starting particulates 24 are maintained in the solid state, the position of the dispersoid forming component 16 remains random, so the resulting dispersoids remains random within the dispersoid hardened metallic material 10.

In some embodiments, there is a migration temperature below the melting point of the starting composition 12 where the dispersoid forming component 16 begins to migrate within a starting particulates 24 before the bulk of the starting particulates 24 melts. In such a case, the dispersoid forming component 16 may agglomerate somewhat, which produces larger dispersoids. Therefore, the oxidizing temperature may be controlled at less than the migration temperature where the dispersoid forming component 16 becomes mobile within the starting powder 22, such as about 10° C. below the melting point of the base metal component 14 or the alloy material 18 with the lowest melting point.

The oxidizing agent within the fluidizing gas 26 is present at a partial pressure that aids in selectively oxidizing the dispersoid forming component 16 over the base metal component 14 or the alloy material 18. Thermodynamic principles can aid in selecting an oxidizing temperature and a partial pressure of the oxidizing agent that will oxidize the dispersoid forming component 16 while minimizing the oxidation of either the base metal component 14 or the alloy material 18. Such thermodynamic principles can be calculated, and are readily available in many embodiments, such as Ellingham diagrams. Higher oxidizing temperatures and the higher partial pressures of the oxidizing agent can increase the rate of oxidation of the dispersoid forming component 16, but higher oxidizing temperatures and partial pressures of the oxidizing agent also increase the likelihood of oxidation of the base metal component 14 and/or an alloy material 18. As such, the oxidizing temperature and partial pressure of the oxidizing agent are selected to provide good selectivity to oxidize the dispersoid forming component 16 over the base metal component 14 and the alloy material 18, and this is balanced with providing a favorable rate of oxidation of the dispersoid forming component 16. In an exemplary embodiment, the oxidizing temperature influences the movement of the oxidizing agent into the starting particles 24, as well as influencing the oxidizing selectivity of the dispersoid forming component 16 and the base metal component 14. The oxidizing temperature may be selected to provide sufficient oxidizing agent movement within the starting particles 24 such that about 50 weight percent or more of the dispersoid forming component 16 is oxidized within about 16 hours or less while about 95 weight percent or more of the base metal component 14 and about 95 weight percent or more of the alloy material 18 (if present) are present in the reduced state.

Oxidation of the dispersoid forming component 16 to form the dispersoids converts the starting powder 22 into the dispersoid hardened metallic material 10. The dispersoid hardened metallic material 10 is collected, and may be kept below the melting point of the dispersoid hardened metallic material 10 to prevent any agglomeration or segregation of components. The dispersoid hardened metallic material 10 in the powder form can be used in a wide variety of manners. For example, the powdered dispersoid hardened metallic material 10 can be formed into an article by a wide variety of methods, such as forging, sintering and forging, extrusion, three dimensional printing (such as direct metal laser sintering, direct metal laser melting, electron beam printing, etc.), plasma spraying, cladding, etc. The dispersoids remain randomly positioned within the dispersoid hardened metallic material 10, so an article formed by extrusion or other methods may not have any directionality in its properties. Extrusion often produces an article with different shear strengths, hardness, or other properties in different directions, such as parallel with the axis of extrusion compared to perpendicular to the axis of extrusion. The random nature of the dispersoid positioning may avoid directional aspects of the article properties formed from the dispersoid hardened metallic material 10.

While at least one embodiment has been presented in the foregoing detailed description of the invention, it should be appreciated that a vast number of variations exist. It should also be appreciated that the embodiment or embodiments are only examples, and are not intended to limit the scope, applicability, or configuration in any way. Rather, the foregoing detailed description will provide those skilled in the art with a convenient road map for implementing an embodiment, it being understood that various changes may be made in the function and arrangement of elements described without departing from the scope as set forth in the appended claims and their legal equivalents.

What is claimed is:

1. A method of forming a dispersoid hardened metallic material comprising:

forming a starting composition comprising a base metal component and a dispersoid forming component, wherein the starting composition comprises the base metal component in an amount of from about 50 weight percent to about 99.999 weight percent and the dispersoid forming component in an amount from about 0.001 weight percent to about 1 weight percent based on the total weight of the starting composition;

forming a starting powder from the starting composition;

fluidizing the starting powder with a fluidizing gas for a period of time sufficient to oxidize the dispersoid forming component within the starting powder and to form the dispersoid hardened metallic material, wherein the dispersoid forming component is oxidized while the starting powder is a solid.

2. The method of claim 1 wherein fluidizing the starting powder comprises fluidizing the starting powder at an oxidizing temperature for a period of time sufficient to oxide about 50 weight percent or more of the dispersoid forming component while about 95 weight percent or more of the base metal component is present in a reduced state, wherein the fluidizing gas is at an oxidizing temperature below a melting point of the base metal component.

3. The method of claim 1 wherein forming the starting composition comprises forming the starting composition with the base metal component, wherein the base metal component is selected from the group consisting of nickel, cobalt, iron, copper, or a combination thereof.

4. The method of claim 1 wherein forming the starting composition comprises forming the starting composition comprising an alloy material.

5. The method of claim 1 wherein forming the starting composition comprises forming the starting composition with the dispersoid forming component, wherein the dispersoid forming component has an affinity to oxygen greater than or equal to that of aluminum.

6. The method of claim 1 wherein forming the starting composition comprises forming the starting composition with the dispersoid forming component, wherein the dispersoid forming component is selected from the group consisting of hafnium, zirconium, yttrium, scandium, lanthanum, cerium, praseodymium, neodymium, promethium, samarium, europium, gadolinium, terbium, dysprosium, holmium, erbium, thulium, ytterbium, lutetium, and a combination thereof.

7. The method of claim 1 wherein oxidizing the dispersoid forming component comprises selecting an oxidizing temperature and an oxidizing agent partial pressure such that about 30 weight percent or more of the dispersoid forming component is oxidized and about 95 weight percent or more of the base metal component is in a reduced state.

8. The method of claim 7 wherein selecting the oxidizing temperature comprises selecting the oxidizing temperature such that about 50 weight percent or more of the dispersoid forming component is oxidized within about 16 hours or less while about 95 weight percent or more of the base metal component is in the reduced state.

9. The method of claim 1 wherein oxidizing the dispersoid forming component comprises forming a plurality of dispersoids, wherein about 95 weight percent or more of the plurality of dispersoids have an average particle size of about 1 micron or less.

10. The method of claim 1 wherein oxidizing the dispersoid forming component comprises forming a plurality of dispersoids, wherein the plurality of dispersoids are randomly positioned within the dispersoid hardened metallic material.

11. A method of forming a dispersoid hardened metallic material comprising:

forming a starting composition comprising a base metal component and a dispersoid forming component, wherein the base metal component comprises from about 50 weight percent to about 99.999 weight percent of the starting composition and the dispersoid forming component comprises from about 0.001 weight percent to about 1 weight percent of the starting composition;

forming a starting powder from the starting composition, wherein the starting powder comprises starting particulates;

fluidizing the starting powder with a fluidizing gas;

diffusing an oxidizing agent into the starting particulates while fluidizing the starting powder, wherein the oxidizing agent is within the fluidizing gas, and where the oxidizing agent is diffused into the starting particles while the starting particulates are in a solid state; and oxidizing the dispersoid forming component within the starting particulates with the oxidizing agent while the starting particulates are in the solid state to form the dispersoid hardened metallic material.

12. The method of claim 11 wherein forming the starting powder comprises forming the starting particulates with an average particle size of about 50 microns or less.

13. The method of claim 11 wherein oxidizing the dispersoid forming component within the starting particulates comprises oxidizing about 50 weight percent or more of the dispersoid forming component within the starting particulates.

14. The method of claim 11 wherein oxidizing the dispersoid forming component comprises forming a dispersoid, wherein about 95 weight percent or more of the base metal component is present in a reduced state.

15. The method of claim 11 wherein oxidizing the dispersoid forming component comprises forming a dispersoid with an average particle size of about 1 micron or less.

16. The method of claim 11 wherein forming the starting composition comprises selecting the base metal component from the group consisting of nickel, cobalt, iron, copper, and a combination thereof, and selecting the dispersoid forming component from the group consisting of hafnium, zirconium, yttrium, scandium, lanthanum, cerium, praseodymium, neodymium, promethium, samarium, europium, gadolinium, terbium, dysprosium, holmium, erbium, thulium, ytterbium, lutetium, and a combination thereof.

17. A method of forming a dispersoid hardened metallic material comprising:

forming a starting composition comprising a base metal component and a dispersoid forming component, wherein the base metal component comprises from about 50 weight percent to about 99.999 weight percent of the starting composition and the dispersoid forming component comprises from about 0.001 weight percent to about 1 weight percent of the starting composition;

fluidizing the starting composition with a fluidizing gas, wherein the fluidizing gas comprises an oxidizing agent partial pressure selected to preferentially oxidize the dispersoid forming component over the base metal component; and preferentially oxidizing about 50 weight percent or more of the dispersoid forming component within the starting composition while the starting composition is in a solid state, wherein about 95 weight percent or more of the base metal component is present in a reduced state.

18. The method of claim 17 further comprising:

forming the starting composition into a starting powder having an average particle size of about 50 microns or less.

19. The method of claim 17, wherein:

preferentially oxidizing the dispersoid forming component comprises converting the starting powder into a dispersoid hardened metallic material; the method further comprising;

forming the dispersoid hardened metallic material into an article.

20. The method of claim 17 wherein forming the starting composition comprises selecting the dispersoid forming component with an affinity to oxygen equal to or greater than that of aluminum.

* * * * *